United States Patent [19]

Kallies

[11] 4,018,268

[45] Apr. 19, 1977

[54] INDUCTION AIR-CONDITIONING APPARATUS

[76] Inventor: Henrik Kallies, Pflugacker 25a, 2 Hamburg 57, Germany

[22] Filed: Apr. 19, 1976

[21] Appl. No.: 678,399

Related U.S. Application Data

[63] Continuation of Ser. No. 499,141, Aug. 21, 1974, abandoned.

[52] U.S. Cl. ..... 165/86; 165/48; 165/61; 165/96; 165/103; 165/123; 165/137

[51] Int. Cl.[2] ..... F24F 3/08; F28D 11/04; F28F 5/00; F28F 13/06

[58] Field of Search ..... 165/48, 58, 59, 61, 165/65, 86, 96, 100, 101, 103, 137, 123

[56] References Cited

UNITED STATES PATENTS

| | | | |
|---|---|---|---|
| 2,147,283 | 2/1939 | Covell | 165/86 |
| 2,405,411 | 8/1946 | Dybuig | 165/86 X |
| 3,465,814 | 9/1969 | Heck et al. | 165/59 X |
| 3,623,542 | 11/1971 | Fragnito et al. | 165/123 X |
| 3,640,338 | 2/1972 | Boyce | 165/48 |
| 3,708,011 | 1/1973 | Serratto | 165/48 X |
| 3,730,263 | 5/1973 | Anderson | 165/86 |

FOREIGN PATENTS OR APPLICATIONS

| | | | |
|---|---|---|---|
| 310,478 | 1/1919 | Germany | 165/96 |

*Primary Examiner*—C. J. Husar
*Assistant Examiner*—Sheldon Richter
*Attorney, Agent, or Firm*—Beaman & Beaman

[57] ABSTRACT

The invention pertains to air-conditioning apparatus capable of selectively heating, cooling or circulating air by the use of separate heating and cooling heat exchangers and a neutral zone selectively located within the airflow path through the apparatus. The heating and cooling heat exchangers are in the form of circular segments mounted upon support structure rotatable about an axis and separated by a neutral zone, and pivoting of the support structure about the axis selectively locates one of the heat exchangers or the neutral zone within the apparatus air inlet.

1 Claim, 1 Drawing Figure

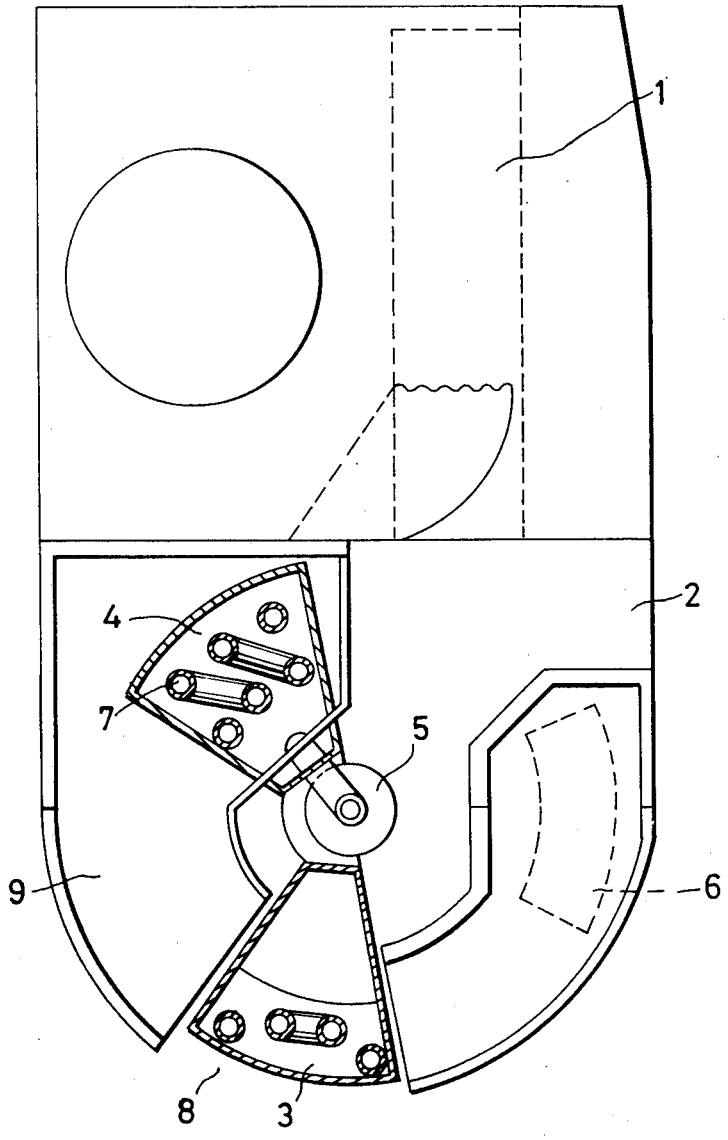
1
2
4
7
5
9
6
8
3

INDUCTION AIR-CONDITIONING APPARATUS

This is a continuation of application Ser. No. 499,141, filed Aug. 21, 1974 now abandoned.

This invention relates to induction air-conditioning apparatus for use in a high-pressure air-conditioning plant.

Such induction air-conditioning apparatus serve to bring the room air to a desired temperature, in that conditioned primary air issues from nozzles and generates in their surroundings a negative pressure so that secondary air flows thereafter from the room. According to need this secondary air is cooled or heated by being conducted past heat exchangers - heaters or coolers.

In known induction air-conditioning apparatuses the regulation as to whether the room air is cooled or heated is carried out either by means of warm or cold water being regulated in quantity through the valves seated in the water cycle of the heat exchangers, or the secondary air being guided by means of the positioning of an air flap so that it flows past either the heater or the cooler. Both the valves and the flap mechanism are controlled by means of a thermostat.

Both methods however possess considerable disadvantages. In the case of the valve-regulated apparatus there is danger of frequent valve soiling, so that a continuous satisfactory regulation is not possible. Furthermore it is difficult where there are a large number of valves (for example approximately 2,000 in a tall office building) to check which valves are still working satisfactorily and which no longer allow satisfactory regulation owing to soiling.

In induction appliances working with air flaps, the sealing of the flap mechanism causes difficulties. The seals can become defective with age, so that by-passes occur. If the seal is fitted too tightly, the tightness of movement of the flap can likewise impair operation. Moreover there are difficulties in checking the operational activity of the flaps.

The invention aims to solve the problem of providing an induction air-conditioning apparatus in which the sucked-in room air is not deflected by any means, nor is the water circulation regulated by valves, but a control mechanism independent of the air and water media is used to carry out the decision as to whether heating or cooling is effected.

This problem is solved in accordance with the invention in that heat exchangers consisting of a cooler and a heater are mounted rotatably about a common axis in such a way that one heat-exchanger can be rotated in each case into an air inlet passage.

In order to make such a rotation possible in a simple way, the heat-exchangers are preferably made in the form of circle segments in section and their water conduits are provided with flexible conduits.

The advantages achieved with the invention consist especially in that in place of complicated regulating mechanisms which control either the water circulation in the heat-exchangers or the air supply over stationary heat-exchangers, a simply operated device is used for the optional heating or cooling of the secondary air, in which no uncontrolled by-passes can occur, only one heat-exchanger is ever situated in the secondary air inlet passage, no phenomena of wear and ageing of mechanically moved sealing parts occur and no valve soiling is possible, thereby the life of such a plant is increased and the susceptibility to breakdown is reduced. Furthermore it is easily possible to monitor the full operational capacity of the installation, even if a large number of installations are present. In addition constructional advantages are obtained because the front of the induction air-conditioning appliance can be smooth and no longer requires a sheet-metal casing.

The invention will now be further described, by way of example, with reference to the accompanying drawing which illustrates a lateral elevation of an induction air-conditioning apparatus according to the invention.

The induction air-conditioning apparatus shown consists of a primary part 1 and a secondary part 2 with an inlet opening 8 on the under side, through which the room air to be drawn in (secondary air) enters the apparatus. In order either to cool or to heat this air, in the apparatus there are two heat-exchangers, made in circular segment form in section, a heater 3 and a cooler 4, which are arranged rotatably about a common axis 5. The heater-exchangers are set in the inlet passage against the secondary air by means of a mechanical drive and rotation about the common axis. According to whether there is need for cooling or heating, either the cooler 4 or the heater 3 is pushed into the air inlet. It is impossible here for an uncontrolled by-pass to occur, since only one or the other heat-exchanger can be situated at the secondary air inlet 8. Between the two heat-exchangers a neutral zone 9 is provided which comes into action when neither cooling nor heating is to be effected.

In the drawing the heater 3 is shown situated in the secondary air inlet opening 8, so that the entering air is heated. The position 6 of the heater when the cooler 4 is situated in the secondary air inlet passage is indicated in chain-line form.

Since the heat-exchangers are movable, the pipes 7 through which the water flows must be connected with the air of flexible conduits. These can preferably consist of flexible steel link hoses, and the use of these raises no problems, since the water pressures present amount to a maximum of 2 atmospheres excess, and such pipes can be used for much greater pressures.

In the illustrated embodiment the rotation of the heat-exchangers takes place by means of a motor drive which is controlled by a thermostat. However it is equally possible to rotate the respective heat-exchangers by hand into and out of the secondary air inlet passage, for which a suitable device is fitted.

If desired the apparatus can be provided with filters on the secondary air inlet position, likewise with a condensate sump if necessary.

Since the front of the apparatus as shown is smooth and can be treated by coloration or can consist of a material which requires no further outer casing, a sheet-metal casing is unnecessary in the embodiment shown.

What we claim is:

1. Air-conditioning apparatus comprising, in combination, a housing having an inlet and an outlet and fixed air guiding panels defining a stationary airflow path through said housing, an air heating heat exchanger within said housing, an air cooling heat exchanger within said housing, a rotatable heat exchanger support supporting said heat exchanges within said housing for rotation about an axis whereby said heating and cooling heat exchangers are selectively positionable within said airflow path to selectively heat or cool the air flowing through said housing, said rotatable support being mounted within said housing adjacent said inlet whereby said heat exchangers are selectively rotatable into said inlet and said airflow path, said heat exchangers being mounted on said support in spaced circumferential relation with respect to the axis of support rotation defining a neutral zone for selective positioning within said airflow path whereby upon positioning said neutral zone within said inlet air may enter said housing through said inlet through said neutral zone bypassing said heat exchangers.

* * * * *